US009574455B2

(12) United States Patent
McCaffrey

(10) Patent No.: US 9,574,455 B2
(45) Date of Patent: Feb. 21, 2017

(54) BLADE OUTER AIR SEAL WITH COOLING FEATURES

(75) Inventor: Michael G. McCaffrey, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 459 days.

(21) Appl. No.: 13/549,874

(22) Filed: Jul. 16, 2012

(65) Prior Publication Data

US 2014/0017072 A1 Jan. 16, 2014

(51) Int. Cl.
*F01D 11/12* (2006.01)
*F01D 11/24* (2006.01)
*F01D 25/12* (2006.01)

(52) U.S. Cl.
CPC ..... *F01D 11/127* (2013.01); *F01D 11/12* (2013.01); *F01D 11/24* (2013.01); *F01D 25/12* (2013.01); *F05D 2260/22141* (2013.01); *Y10T 29/49245* (2015.01)

(58) Field of Classification Search
CPC ..... F01D 25/12; F01D 11/24; F01D 11/08; F01D 11/127; F01D 11/12; F05D 2260/22141
USPC ..... 415/173.1, 177
See application file for complete search history.

(56) References Cited

U.S. PATENT DOCUMENTS 3,365,172 A * 1/1968 Howald ..... F01D 11/08 277/414
3,423,070 A 1/1969 Corrigan
3,742,705 A * 7/1973 Sifford ..... F01D 11/18 415/116
4,213,296 A * 7/1980 Schwarz ..... F01D 25/08 415/116
5,816,453 A 10/1998 Spencer et al.
6,164,656 A * 12/2000 Frost ..... F16J 15/0887 277/312
6,170,831 B1 1/2001 Bouchard
6,302,642 B1 * 10/2001 Nagler ..... F01D 11/24 415/116
6,340,285 B1 * 1/2002 Gonyou ..... F01D 11/005 415/116
6,468,026 B1 * 10/2002 Bonnoitt et al. ..... 415/9
(Continued)

FOREIGN PATENT DOCUMENTS

EP 2206893 A2 7/2010
EP 1162346 A2 12/2011
(Continued)

OTHER PUBLICATIONS

International Search Report and Written Opinion for International Application No. PCT/US2013/050232 completed on Sep. 12, 2013.
(Continued)

*Primary Examiner* — Richard Edgar
(74) *Attorney, Agent, or Firm* — Carlson, Gaskey & Olds

(57) ABSTRACT

A blade outer air seal (BOAS) for a gas turbine engine according to an exemplary aspect of the present disclosure includes, among other things, a seal body having a radially inner face and a radially outer face that axially extend between a leading edge portion and a trailing edge portion. At least one cooling fin is disposed on the radially outer face between the leading edge portion and the trailing edge portion.

10 Claims, 3 Drawing Sheets

(56) References Cited

U.S. PATENT DOCUMENTS

| | | | | |
|---|---|---|---|---|
| 6,602,048 | B2 * | 8/2003 | Fujikawa | F01D 9/00 415/116 |
| 6,602,050 | B1 * | 8/2003 | Scheurlen | F01D 11/08 415/173.1 |
| 6,641,363 | B2 * | 11/2003 | Barrett | F01D 9/04 415/108 |
| 6,652,226 | B2 * | 11/2003 | Wines et al. | 415/173.4 |
| 6,997,673 | B2 | 2/2006 | Morris et al. | |
| 7,473,073 | B1 | 1/2009 | Liang | |
| 7,553,128 | B2 | 6/2009 | Abdel-Messeh et al. | |
| 7,597,533 | B1 | 10/2009 | Liang | |
| 7,665,962 | B1 | 2/2010 | Liang | |
| 7,686,570 | B2 * | 3/2010 | Allen | 415/9 |
| 7,704,039 | B1 | 4/2010 | Liang | |
| 8,061,979 | B1 | 11/2011 | Liang | |
| 8,123,466 | B2 | 2/2012 | Pietraszkiewicz et al. | |
| 8,182,221 | B1 | 5/2012 | Liang | |
| 8,662,824 | B2 * | 3/2014 | Chatelois | F01D 21/045 415/115 |
| 2008/0211192 | A1 * | 9/2008 | Pietraszkiewicz | F01D 11/08 277/347 |
| 2009/0081025 | A1 | 3/2009 | Lutjen et al. | |
| 2010/0040479 | A1 | 2/2010 | Spangler et al. | |

FOREIGN PATENT DOCUMENTS

| | | | | |
|---|---|---|---|---|
| GB | 2378730 | A | 2/2003 | |
| JP | 2000320837 | A * | 11/2000 | F23R 3/42 |
| WO | 00/57033 | | 9/2000 | |

OTHER PUBLICATIONS

International Preliminary Report on Patentability for International Application No. PCT/US2013/050232 dated Jan. 29, 2015.

Extended European Search Report for Application No. EP 13 81 9631 dated Jun. 16, 2015.

* cited by examiner

BLADE OUTER AIR SEAL WITH COOLING FEATURES

BACKGROUND

This disclosure relates to a gas turbine engine, and more particularly to a blade outer air seal (BOAS) that may be incorporated into a gas turbine engine.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

A casing of an engine static structure may include one or more blade outer air seals (BOAS) that provide an outer radial flow path boundary for the hot combustion gases. The BOAS surrounds rotor assemblies that carry one or more blades that rotate and extract energy from the hot combustion gases communicated through the gas turbine engine. The BOAS may be subjected to relatively extreme temperatures during gas turbine engine operation.

SUMMARY

A blade outer air seal (BOAS) for a gas turbine engine according to an exemplary aspect of the present disclosure includes, among other things, a seal body having a radially inner face and a radially outer face that axially extend between a leading edge portion and a trailing edge portion. At least one cooling fin is disposed on the radially outer face between the leading edge portion and the trailing edge portion.

In a further non-limiting embodiment of the foregoing BOAS, a plurality of cooling fins axially extend between the leading edge portion and the trailing edge portion.

In a further non-limiting embodiment of either of the foregoing BOAS, at least one cooling fin extends across an entire length between the leading edge portion and the trailing edge portion.

In a further non-limiting embodiment of any of the foregoing BOAS, at least one cooling fin axially extends between the leading edge portion and the trailing edge portion.

In a further non-limiting embodiment of any of the foregoing BOAS, a plurality of cooling fins are circumferentially disposed about the radially outer surface of the seal body.

In a further non-limiting embodiment of any of the foregoing BOAS, the leading edge portion includes an engagement feature that receives a portion of a support structure of the gas turbine engine.

In a further non-limiting embodiment of any of the foregoing BOAS, a seal is attached to the radially inner face of the seal body.

In a further non-limiting embodiment of any of the foregoing BOAS, the seal is a honeycomb seal.

In a further non-limiting embodiment of any of the foregoing BOAS, a thermal barrier coating is applied to the radially inner face of the seal body between the leading edge portion and the trailing edge portion.

In a further non-limiting embodiment of any of the foregoing BOAS, at least one cooling fin extends at a non-perpendicular angle relative to the radially outer face.

A gas turbine engine according to another exemplary aspect of the present disclosure includes, among other things, a compressor section, a combustor section in fluid communication with the compressor section, and a turbine section in fluid communication with the combustor section. A blade outer air seal (BOAS) is associated with at least one of the compressor section and the turbine section. The BOAS includes a seal body having a radially inner face and a radially outer face that axially extend between a leading edge portion and a trailing edge portion and at least one cooling fin disposed on the radially outer face between the leading edge portion and the trailing edge portion.

In a further non-limiting embodiment of the foregoing gas turbine engine, the BOAS is positioned radially outward from a blade tip of a blade of at least one of the compressor section and the turbine section.

In a further non-limiting embodiment of either of the foregoing gas turbine engines, a plurality of cooling fins axially extend across the radially outer face between the leading edge portion and the trailing edge portion.

In a further non-limiting embodiment of any of the foregoing gas turbine engines, at least one cooling fin axially extends between the leading edge portion and the trailing edge portion.

In a further non-limiting embodiment of any of the foregoing gas turbine engines, a plurality of cooling fins are disposed on the radially outer surface. A first portion of the plurality of cooling fins include a first length and a second portion of the plurality of cooling fins include a second length that is different from the first length.

In a further non-limiting embodiment of any of the foregoing gas turbine engines, at least one cooling fin includes a first height adjacent to the leading edge portion and a second height that is different from the first height adjacent to the trailing edge portion.

A method of providing a blade outer air seal (BOAS) for a gas turbine engine, according to another exemplary aspect of the present disclosure includes, among other things, providing the BOAS with at least one cooling fin on a radially outer face of the BOAS.

In a further non-limiting embodiment of the foregoing method of providing a blade outer air seal (BOAS) for a gas turbine engine, the method may include a plurality of cooling fins circumferentially disposed about the radially outer face.

In a further non-limiting embodiment of either of the foregoing methods of providing a blade outer air seal (BOAS) for a gas turbine engine, the method communicates an airflow across the at least one cooling fin to cool the BOAS.

In a further non-limiting embodiment of any of the foregoing methods of providing a blade outer air seal (BOAS) for a gas turbine engine, the method may include providing at least one cooling fin extending axially between a leading edge portion and a trailing edge portion of the BOAS.

The various features and advantages of this disclosure will become apparent to those skilled in the art from the following detailed description. The drawings that accompany the detailed description can be briefly described as follows.

DETAILED DESCRIPTION

Figure 1:
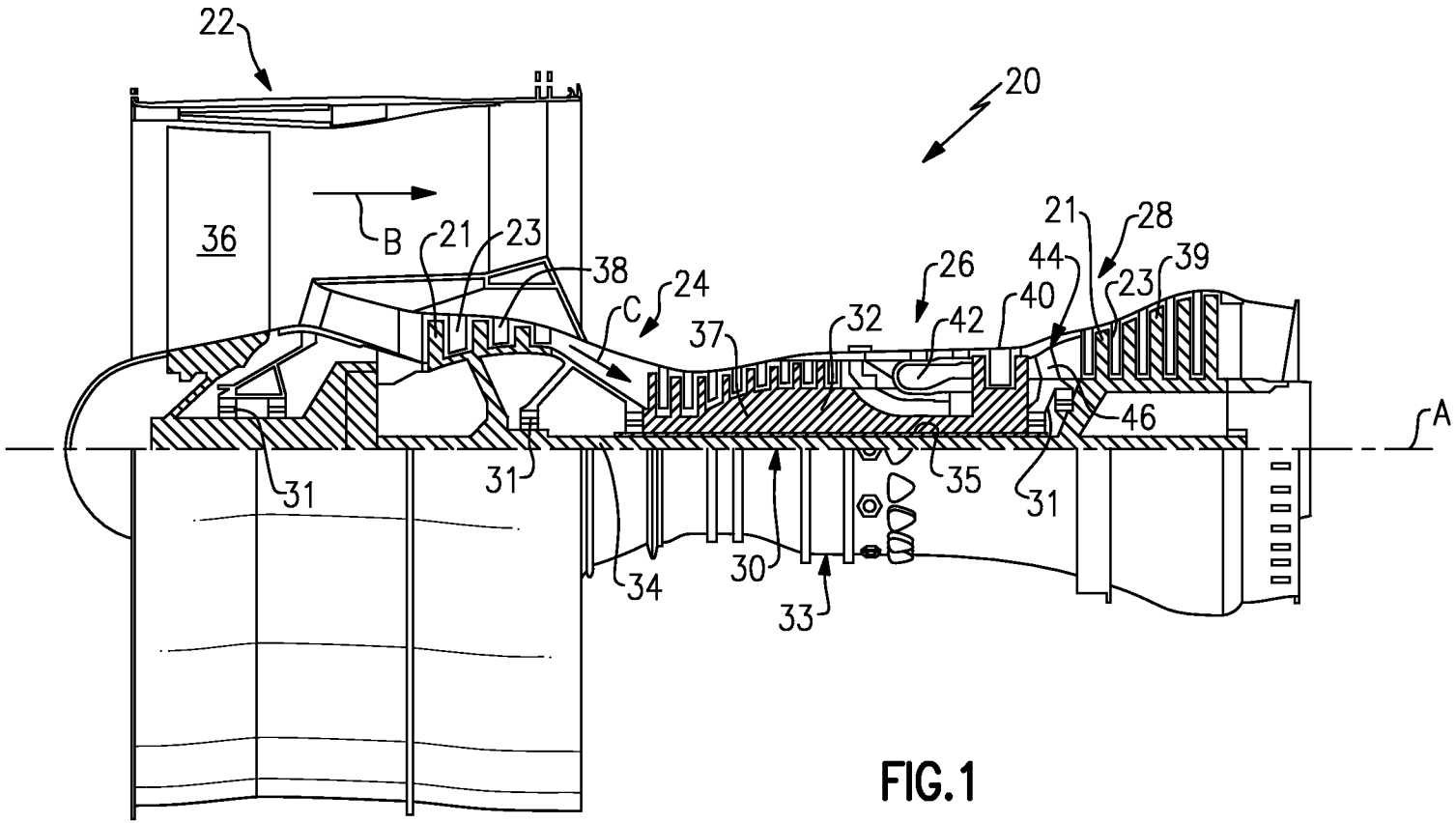
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, turboshaft engines.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that additional bearing systems 31 may alternatively or additionally be provided.

The low speed spool 30 generally includes an inner shaft 34 that interconnects a fan 36, a low pressure compressor 38 and a low pressure turbine 39. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 supports one or more bearing systems 31 of the turbine section 28. The mid-turbine frame 44 may include one or more airfoils 46 that may be positioned within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion. The compressor section 24 and the turbine section 28 can each include alternating rows of rotor assemblies and vane assemblies. The rotor assemblies carry a plurality of rotating blades 21, while each vane assembly includes a plurality of vanes 23.

Figure 2:
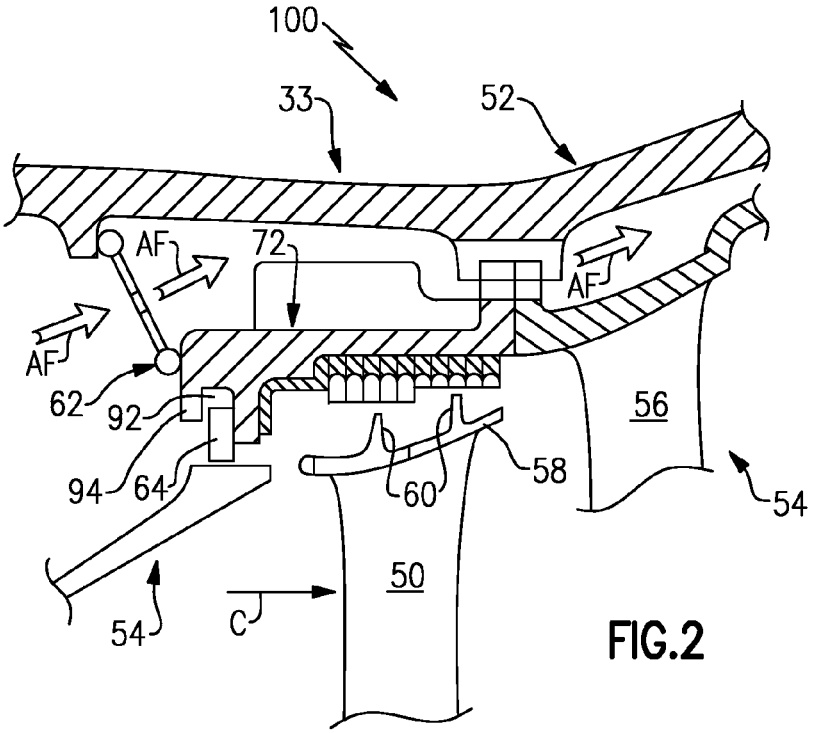
FIG. 2 illustrates a cross-section of a portion of a gas turbine engine.

FIG. 2 illustrates a portion 100 of a gas turbine engine, such as the gas turbine engine 20 of FIG. 1. In this exemplary embodiment, the portion 100 represents part of the turbine section 28. However, it should be understood that other portions of the gas turbine engine 20 could benefit from the teachings of this disclosure, including but not limited to, the compressor section 24.

In this exemplary embodiment, a blade 50 (only one shown, although multiple blades could be circumferentially disposed about a rotor disk (not shown) within the portion 100) is mounted for rotation relative to a casing 52 of the engine static structure 33. In the turbine section 28, the blade 50 rotates to extract energy from the hot combustion gases that are communicated through the gas turbine engine 20. The portion 100 can also include a vane assembly 54 supported within the casing 52 at a downstream position from the blade 50. The vane assembly 54 includes one or more vanes 56 that prepare the airflow for the next set of blades. Additional vane assemblies could also be disposed within the portion 100, including at a position upstream from the blade 50.

The blade 50 includes a blade tip 58 that is positioned at a radially outermost portion of the blade 50. In this exemplary embodiment, the blade tip 58 includes a knife edge 60 that extends toward a blade outer air seal (BOAS) 72. The BOAS 72 establishes an outer radial flow path boundary of the core flow path C. The knife edge 60 and the BOAS 72 cooperate to limit airflow leakage around the blade tip 58.

The BOAS 72 is disposed in an annulus radially between the casing 52 and the blade tip 58. Although this particular embodiment is illustrated in a cross-sectional view, the BOAS 72 may form a full ring hoop assembly that circumscribes associated blades 50 of a stage of the portion 100.

A seal member 62 is mounted radially inward from the casing 52 to the BOAS 72 to limit the amount of airflow AF to the annular cavity formed by the casing 52 and the BOAS 72. A second seal member 64 can also be used, in conjunction with a flowpath member, to limit the amount of airflow leakage into the core flow path C. The second seal member 64 can mountably receive the BOAS 72. The seal member 62 can also press the BOAS 72 axially against the adjacent vane assembly 54, which forms a seal between the BOAS 72 and the vanes 56 to further limit cooling air leakage into the core flow path C.

In this exemplary embodiment, a dedicated cooling airflow, such as bleed airflow, is not communicated to cool the BOAS 72. Instead, as is further discussed below, the BOAS 72 can include cooling features that increase a local heat transfer effect of the BOAS 72 without requiring a large flow pressure ratio.

Figure 3:
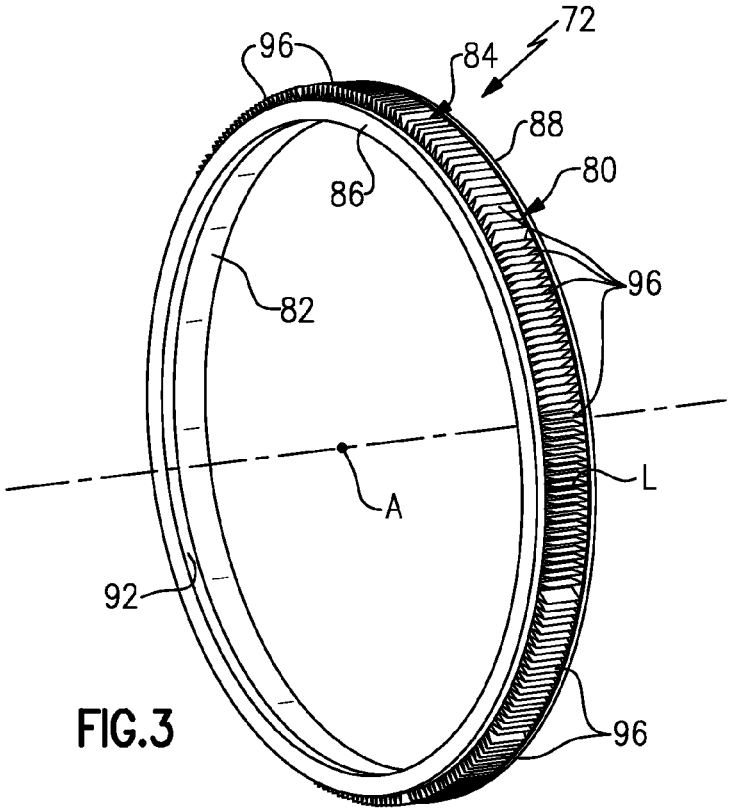
FIG. 3 illustrates a perspective view of a blade outer air seal (BOAS).

FIG. 3 illustrates one exemplary embodiment of a BOAS 72 that may be incorporated into a gas turbine engine, such as a gas turbine engine 20. The BOAS 72 of this exemplary embodiment is a full ring BOAS that can be circumferentially disposed about the engine centerline longitudinal axis A. The BOAS 72 can be formed as a single piece construction using a casting process or some other manufacturing technique. The BOAS 772 could also be segmented to include a plurality of BOAS segments within the scope of this disclosure.

The BOAS 72 includes a seal body 80 having a radially inner face 82 and a radially outer face 84. Once positioned within the gas turbine engine 20, the radially inner face 82 faces toward the blade tip 58 (i.e., the radially inner face 82 is positioned on the core flow path side) and the radially outer face 84 faces the casing 52 (i.e., the radially outer face 84 is positioned on a non-core flow path side). The radially inner face 82 and the radially outer face 84 axially extend between a leading edge portion 86 and a trailing edge portion 88.

The leading edge portion 86 and the trailing edge portion 88 may include one or more attachment features 94 for sealing the BOAS 72 to the seal member 62 (FIG. 2). In this exemplary embodiment, the leading edge portion 86 includes a hook 92 that receives the second seal member 64 to seal the BOAS 72 to the flowpath member.

The BOAS 72 can also include one or more cooling fins 96 disposed on the radially outer face 84 of the seal body 80. In this exemplary embodiment, the BOAS 72 includes a plurality of circumferentially spaced cooling fins 96. The cooling fins 96 can extend between a length L that extends between the leading edge portion 86 and the trailing edge portion 88. In one exemplary embodiment, the cooling fins 96 extend across the entire length L between the leading edge portion 86 and the trailing edge portion 88.

The cooling fins 96 can be cast integrally with the radially outer face 84 of the seal body 80. In one exemplary embodiment, the BOAS 72 is made of a material having a relatively low coefficient of thermal expansion. Example materials include, but are not limited to, Mar-M-247, Hastaloy N, Hayes 242 and PWA 1456 (IN792+Hf). Other materials may also be utilized within the scope of this disclosure.

Figure 4:
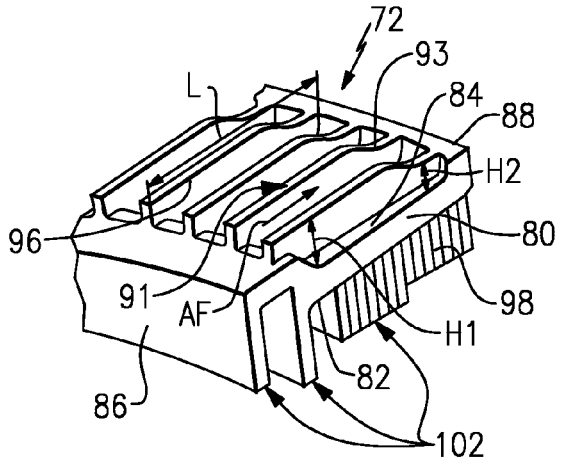
FIG. 4 illustrates a portion of the BOAS of FIG. 3.

FIG. 4 illustrates a portion of the BOAS 72 of FIG. 3. A seal 98 can be secured to the radially inner face 82 of the seal body 80. The seal 98 can be brazed to the radially inner face 82, or could be attached using other known attachment techniques. In one example, the seal 98 is a honeycomb seal that interacts with a blade tip 58 of a blade 50 (See FIG. 2) to reduce airflow leakage around the blade tip 58.

A thermal barrier coating 102 can also be applied to at least a portion of the radially inner face 82 and/or the seal 98. In this exemplary embodiment, the thermal barrier coating 102 is applied to the radially inner face 82 between the leading edge portion 86 and the trailing edge portion 88. The thermal barrier coating 102 could also partially or completely fill the seal 98 of the BOAS 72. The thermal barrier coating 102 may also be deposited on any flow path connected portion of the BOAS 72 to protect the underlying substrate of the BOAS 72 from exposure to hot gas, reducing thermal fatigue and to enable higher operating conditions. A suitable low conductivity thermal barrier coating 102 can be used to increase the effectiveness of the cooling fins 92 by reducing the heat transfer from the core flow path C to the airflow AF.

The cooling fins 96 include an outer surface 91. The outer surface 91 can include a stepped portion 93 such that each cooling fin 96 includes a varying height across its length L relative to the radially outer face 84 of the BOAS 72. For example, as illustrated in this embodiment, the cooling fins 96 include a first height H1 adjacent to the leading edge portion 86 and include a second height H2 that is different than the first height H1 adjacent to the trailing edge portion 88. In one embodiment, the second height H2 is smaller than the first height H1.

Airflow AF is provided to the engine static structure 33 through the seal member 62 and is communicated into the passage created between the casing 52 and the BOAS 72 to prevent hot combustion gases from the core flow path C from contacting the casing 52. The airflow AF can be communicated across the length L of each cooling fin 96 to cool the BOAS 72 without requiring additional flow, or a dedicated source of cooling air. The cooling fins 96 increase the surface area of the BOAS 72, thereby increasing the local heat transfer effect of the BOAS 72 without requiring a large flow pressure ratio.

Figure 5:
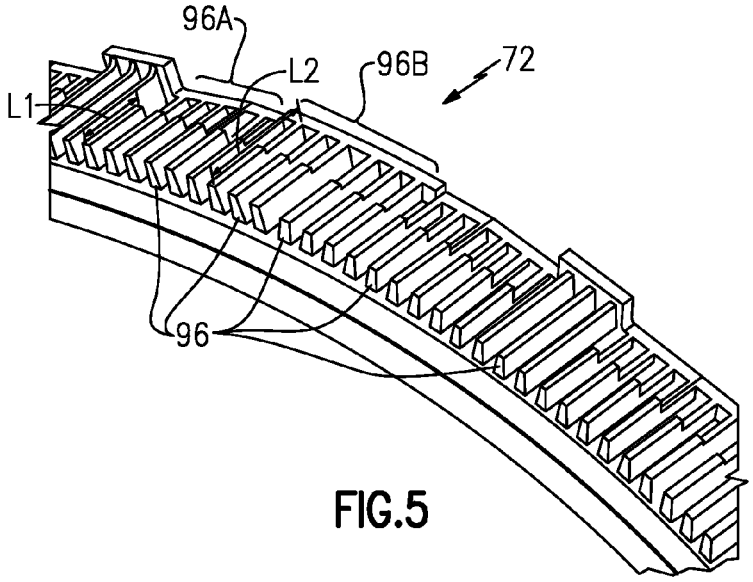
FIG. 5 illustrates another exemplary BOAS.

Referring to the embodiment depicted by FIG. 5, the BOAS 72 can also include a plurality of cooling fins 96 that embody different lengths. In one exemplary embodiment, a first portion 96A of the plurality of cooling fins 96 can include a first length L1, while a second portion 96B of the plurality of cooling fins 96 includes a second length L2 that is greater than the first length L1. The first portion 96A of the plurality of cooling fins 96 can be machined down to the length L1 to provide clearance for mounting the BOAS to the casing 52. The actual dimensions of the lengths L1 and L2 may be design dependent.

Figure 6:
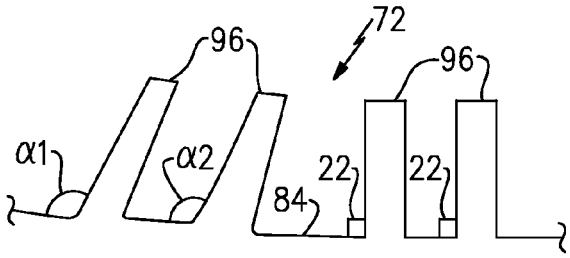
FIG. 6 illustrates exemplary cooling fins that can be incorporated into a BOAS.

FIG. 6 illustrates additional features that may be incorporated into the BOAS 72. In this exemplary embodiment, a portion of the cooling fins 96 can extend at a non-perpendicular angle $\alpha 1$ relative to the radially outer face 84, while another portion of the cooling fins 96 may extend at a perpendicular angle $\alpha 2$ relative to the radially outer face 84. The actual values of the angles $\alpha 1$ and $\alpha 2$ may be design dependent.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would recognize that various modifications could come within the scope of this disclosure. For these reasons, the following claims should be studied to determine the true scope and content of this disclosure.

What is claimed is:

1. A gas turbine engine, comprising:

a compressor section;

a combustor section in fluid communication with said compressor section;

a turbine section in fluid communication with said combustor section;

a blade outer air seal (BOAS) associated with at least one of said compressor section and said turbine section, wherein said BOAS includes:

a seal body having a radially inner face and a radially outer face that axially extend between a leading edge portion and a trailing edge portion; and at least one cooling fin disposed on said radially outer face between said leading edge portion and said trailing edge portion, said at least one cooling fin including an outer surface having a stepped portion that defines a varying height, wherein said stepped portion includes a first height adjacent to said leading edge portion and a second height that is different from said first height adjacent to said trailing edge portion.

2. The gas turbine engine as recited in claim 1, wherein said BOAS is positioned radially outward from a blade tip of a blade of at least one of said compressor section and said turbine section.

3. The gas turbine engine as recited in claim 1, comprising a plurality of cooling fins that axially extend across said radially outer face between said leading edge portion and said trailing edge portion.

4. The gas turbine engine as recited in claim 1, wherein said at least one cooling fin axially extends between said leading edge portion and said trailing edge portion.

5. The gas turbine engine as recited in claim 1, comprising a plurality of cooling fins disposed on said radially outer surface, wherein a first portion of said plurality of cooling fins include a first length and a second portion of said plurality of cooling fins include a second length that is different from said first length.

6. The gas turbine engine as recited in claim 1, wherein said at least one cooling fin extends outboard of a radially outermost surface of at least one of said leading edge portion and said trailing edge portion.

7. The gas turbine engine as recited in claim 1, wherein said at least one cooling fin extends at a perpendicular angle relative to said radially outer face and a second cooling fin extends at a non-perpendicular angle relative to said radially outer face.

8. The gas turbine engine as recited in claim 1, comprising a second cooling fin that includes an outer surface having a uniform height.

9. The gas turbine engine as recited in claim 1, wherein said stepped portion occurs along a length of said outer surface at a location that is spaced from opposing ends of said at least one cooling fin.

10. A blade outer air seal (BOAS) for a gas turbine engine, comprising:

a non-segmented, full hoop seal body having a radially inner face and a radially outer face that axially extend between a leading edge portion and a trailing edge portion;

at least one cooling fin disposed on said radially outer face between said leading edge portion and said trailing edge portion, said at least one cooling fin extending outboard of a radially outermost surface of at least one of said leading edge portion and said trailing edge portion, and said at least one cooling fin including an outer surface that defines a varying height; and a hook that extends in a radially inward direction from said leading edge portion of said seal body.

* * * * *